US006355120B1

(12) United States Patent
Dunand et al.

(10) Patent No.: US 6,355,120 B1
(45) **Date of Patent: *Mar. 12, 2002**

(54) CHEMICALLY INDUCED PLASTIC DEFORMATION

(75) Inventors: David C. Dunand, Evanston, IL (US); Peter Zwigl, El Dorado Hills, CA (US)

(73) Assignee: Massachusetts Institue of Technology, Cambridge, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/471,865

(22) Filed: Dec. 23, 1999

Related U.S. Application Data

(63) Continuation-in-part of application No. 08/820,768, filed on Mar. 19, 1997, now Pat. No. 6,042,661.

(51) Int. Cl.[7] ..... C22F 1/00

(52) U.S. Cl. ..... 148/669; 419/66

(58) Field of Search ..... 148/564, 669, 148/670; 419/38, 66

(56) References Cited

U.S. PATENT DOCUMENTS

| | | | | | |
|---|---|---|---|---|---|
| 4,331,476 | A | * | 5/1982 | Helderman et al. | 419/38 |
| 4,415,375 | A | * | 11/1983 | Lederich et al. | 148/564 |
| 4,505,764 | A | * | 3/1985 | Smickley et al. | 148/670 |
| 4,982,893 | A | * | 1/1991 | Ruckle et al. | 228/220 |
| 5,413,649 | A | * | 5/1995 | Dunand et al. | 148/564 |
| 5,630,890 | A | * | 5/1997 | Smashey et al. | 148/669 |
| 5,980,659 | A | * | 11/1999 | Kawaura et al. | 148/669 |
| 6,042,661 | A | * | 3/2000 | Dunand et al. | 148/564 |

* cited by examiner

*Primary Examiner*—George Wyszomierski
(74) *Attorney, Agent, or Firm*—Cesari and McKenna, LLP

(57) ABSTRACT

The invention produces mismatch plastic deformation in a workpiece by altering the chemical composition of the workpiece material, while the workpiece is subjected to a biasing stress, in a manner that introduces a strain increment into the material, deforming the workpiece without causing failure. In one approach, repeated cyclic alteration of chemical composition, so as to repeatedly alternately induce and reverse a phase transition that produces strain increment, allows accumulation of strain in an incremental fashion thereby achieving overall large, superplastic deformations in the workpiece without applying large stresses.

102 Claims, 2 Drawing Sheets

CHEMICALLY INDUCED PLASTIC DEFORMATION

CROSS REFERENCE TO RELATED APPLICATION

This application is a continuation-in-part of application Ser. No. 08/820,768, filed Mar. 19, 1997, now U.S. Pat. No. 6,042,661.

This invention was made with government support under United States Army contract #DAAH04-95-1-0629. The government has certain rights in this invention.

FIELD OF THE INVENTION

This invention relates to mismatch plastic deformation. More particularly, this invention relates to a technique for inducing mismatch plastic deformation, including transformation-mismatch superplastic deformation, by chemical means.

BACKGROUND OF THE INVENTION

Superplastic deformation is defined as the deformation of a workpiece to a very large strain by application of a small stress without disrupting the mechanical integrity of the workpiece. Although superplastic deformation is universally characterizable by the formula $$\dot{\varepsilon} = A\sigma^n \exp\left(\frac{-Q}{RT}\right)$$

(in which $\dot{\epsilon}$ is strain rate, A is a materials constant, $\sigma$ is stress, R is the gas constant, T is temperature and n is a stress exponent between one and two), this behavior can be produced by any of several different mechanisms. This phenomenon has been exploited in superplastic forming techniques. For example, titanium-based materials are desirable for their specific strength and stiffness at ambient and elevated temperatures but have high resistance to deformation at temperatures appropriate for traditional hot-working operations. However, titanium alloys having a fine, stable grain structure deforms superplastically, a phenomenon known as "fine-grain superplasticity". Titanium-forming techniques based on fine-grain superplasticity only operate successfully within a restricted window of process parameter values. For example, only small strain rates can be imposed, so the process output rate is limited. The deformation mechanism requires that grain size be maintained within certain limits throughout the deformation process.

In another superplastic mechanism, called "transformation superplasticity" (described, e.g., in U.S. Pat. No. 5,413,649, the entire disclosure of which is incorporated herein by reference), the workpiece is cycled repeatedly through a phase transformation by changing the temperature. At the end of each thermal cycle, a strain increment is produced, a phenomenon which can be termed "transformation-mismatch plasticity." The strain can be accumulated upon multiple cycles up to large overall values, at which point the material is considered to have deformed by transformation-mismatch superplasticity (or "transformation-superplasticity"). It is important to note that transformation-mismatch plasticity is produced by the biasing of internal mismatch stresses and is thus distinct from "transformation-induced plasticity" (TRIP) observed in many steels, in which the strain is produced by a biasing of the martensitic shape-change and not by internal mismatch stresses, and thus cannot be accumulated through multiple cycles up to large strain values.

Transformation superplasticity is advantageous compared to earlier approaches to superplasticity in that it is not limited to a workpiece material with a fine-grain microstructure and the grain growth limitation is relaxed. Also, the higher strain rates achievable result in more efficient process output. However, prolonged residence at high temperatures as required for some thermal cycling procedures can promote grain growth to sizes deleterious to the mechanical properties of the finished product. Implementing the required temperature cycling capability can be costly and difficult. Also, repeated thermal cycling can promote fatigue of the treatment apparatus.

DESCRIPTION OF THE INVENTION

Objects of the Invention

An object of the invention is, accordingly, to provide a technique for inducing transformation-mismatch plasticity, including superplasticity, without thermal cycling .

Another object of the invention is to provide a technique for inducing transformation-mismatch plasticity, including superplasticity, that is not limited to any specific workpiece microstructure or composition and is applicable to a wide range of workpiece materials, including titanium-based materials.

Another object of the invention is to provide a powder compaction technique.

Another object of the invention is to provide a technique for forming composites.

Another object of the invention is to provide a method of inducing mismatch plasticity, including superplasticity, without causing the workpiece material to undergo a phase transition.

Another object of the invention is to provide a method of inducing transformation-mismatch plasticity, including superplasticity, that allows fast deformation of the workpiece.

Still another object of the invention is to provide a method of inducing transformation-mismatch plasticity, including superplasticity, that may be applied repeatedly to a workpiece with accumulation of deformation from each repetition.

Brief Summary of the Invention

The method of the e invention produces deformation by mismatch plasticity in a workpiece by altering the chemical composition of the workpiece material—by increasing and/or decreasing the concentration of a chemical component—while the workpiece is subjected to a biasing stress, in a manner that introduces a strain increment into the material, deforming the workpiece without causing, failure. Known apparatus for fine-grain superplastic forming or forging can be modified in a straightforward manner to incorporate the method of the invention by adding a mechanism for introducing and/or withdrawing a chemical component to accomplish the desired chemical composition change. The operation of the method of the invention on the workpiece is such that the mass of the workpiece is not increased thereby except in cases in which chemical component is provided to the workpiece to effect the strain increment and remains in the workpiece at the end of the operation. The method of the invention adds no bulk material to the workpiece, such as would be done by a bonding operation.

The method of the invention is not limited with respect to the deformation geometry it effects. The workpiece may be simply stretched, under uniaxial tension. Or, more elaborate shaping may be performed, for example corrugation of a sheet by superplastic forming into a die or foaming by expansion of internal cavities. The wide range of deformation arrangements achievable by the method of the invention are conveniently described with reference to the effective von Mises strain $e_{eff}$, well known in the art to be defined as $$e_{eff}=\tfrac{2}{3}((e_1-e_2)^2+(e_1-e_3)^2+(e_2-e_3)^2)^{1/2},$$

for a strain state characterizable by principal strains $e_1$, $e_2$ and $e_3$. In a preferred embodiment, the deformation causes the effective von Mises strain to change by a minimum amount at some location in the workpiece. The method of the invention effects a change in the von Mises strain on the order of 0.5% or even greater. Depending on the material, the mismatch plastic strain increment may generate a change in von Mises strain of 5%, even as much as 10% and greater.

The alteration in composition under the biasing stress may be monotonic, resulting in a permanent change in the concentration of the component. Or, after completion of the deformation process the concentration change may be fully reversed, restoring the preprocess mass of the workpiece to within 0.01%, or partially reversed. In one embodiment the concentration alteration under stress is cyclic, comprising an initial change of the concentration of the chemical component in a first direction, followed by change in the opposite direction to accomplish a partial or total reversal of the initial change while the workpiece remains subject to the biasing stress. As used herein, reversing the concentration change encompasses a partial reversal as well as a full reversal, and the stipulation that the composition of the workpiece be altered while the workpiece is subject to the biasing stress denotes that a nonzero biasing stress is in effect at some time during the concentration changing operation. The biasing stress need not be constant during a unidirectional concentration change or follow the same profile during a part of the procedure adding chemical component to the workpiece as during a part of the procedure removing chemical component from the workpiece.

In one approach, the composition changes within a single-phase stability field, a concomitant change in lattice strain producing the internal mismatch and thus the strain increment without phase transformation. In another approach, the alteration in composition induces a phase transition that gives rise to an internal transformation mismatch and the concomitant strain increment. The scope of the invention is not limited with respect to type of phase transition or workpiece material, as long as it produces an internal mismatch due to volume and/or shape incompatibility between the two phases involved in the phase transition. The phase transition may be, for example, allotropic, martensitic, peritectoid or eutectoid in nature. Or the phase transition may involve precipitation of a compound due to solute saturation. The term "compound" as used herein, as it is normally understood by those in the art, does not merely mean proximal coexistence between elements, but includes specific inter-element interaction and a requires that the compound be distinct from its component elements. The method of the invention is compatible with, but not limited to, metallic ionic and covalent materials including pure metals and alloys, such as intermetallics, ceramic, polymeric or geologic workpiece materials.

The imposed change in composition in the material may affect all of the workpiece material or only a part of it. The overall deformation is generally proportional to the fraction of the workpiece involved in the alteration. As used in this document, the term "segment" refers to the portion of the workpiece material undergoing a composition change and/or a phase transformation, whether it corresponds to the entire workpiece or not. The segment may, for example, form a continuous layer surrounding an unaltered core or be a collection of distinct isolated regions, each surrounded by unaltered material. In the case of phase transition, each forward or reverse transformation changes the transformed segment with respect to some aspect—its specific volume or, in some instances, some geometric aspect such as lattice type, lattice orientation or shape—so that the transformation generates an internal transformation-mismatch stress in the material. In the case of chemical composition cycling it is often desirable that the segment transformed by the reverse transformation correspond to that transformed by the previous forward transformation, so that the original phase constitution of the material is completely restored. However, the invention does not require such a correspondence; some of the material may remain in the forward-transformed state at the end of a cycle.

The transformation may occur along a macroscopic transformation front between an original phase in the material and a new phase in the material, originating in the reaction where the chemical composition change is introduced and advancing into the material in an organized fashion; or they may arise simultaneously at several discrete sites, having phase boundaries that move in random directions during transformation.

The biasing stress influences the orientation of the strain increment to produce the desired mismatch plastic deformation. The biasing stress may originate in a source either internal to, or external to, the sample; or, both internal and external sources may contribute to the bias. Residual internal stress in the workpiece may provide the biasing stress or, if the composition change induces a phase transition, the transformation stress of the phase transition may itself give rise to the bias. In a preferred embodiment, the bias is provided by an externally applied stress, the magnitude of which is chosen according to the strength of the material. Depending on the deformation desired, the externally applied biasing stress may be nonhydrostatic or hydrostatic, having a deviatoric component, such as a uniaxial or multiaxial stress. Such stresses may include tensile, compressive, torsional or bending stresses as are conventionally used to effect, for example, drawing, punching, stamping, extruding, rolling, pulling, bending, and twisting.

In a preferred embodiment, chemical composition cycling is applied to the workpiece repeatedly, each repetition introducing a strain increment. Repetitive cycling in a manner that causes the alternate induction or reversal of a phase transition to recur is especially beneficial. The change in effective von Mises strain per cycle may be as much as 1.5%, or greater. The accumulation of strain in this incremental fashion allows achievement of large overall superplastic deformations in the workpiece without applying large stresses, which would risk disruption of the mechanical integrity of the workpiece. Alternatively, a single cycle or a few cycles suffice if only a small overall strain is desired. The invention does not require that a chemical composition change applied or workpiece segment affected in any given cycle be repeated exactly in any other cycle of a repetitive series; likewise, the biasing stress exerted in one cycle need not correspond to that used in any other cycle of a series.

Although the invention is applicable to a wide range of workpiece materials, alterable by a commensurately broad range of compositional changes, mismatch plastic deformation is most efficiently accomplished if the compositional change is imposed by varying the concentration of a chemical component that can be rapidly transferred to and/or from the targeted region of the workpiece. Using a component having a high diffusivity in the workpiece—for example, hydrogen in titanium metal—or a very thin workpiece—such as a titanium thin film to which aluminum is added—are two practical approaches. For ease of implementation, it is also desirable that the component be easily transportable to and removable from the surface of the workpiece. For example, some chemical components can be transported in the gas phase or produced by reaction at the workpiece of a species delivered in the gas phase. Such a component can then be removed by exposing the workpiece to vacuum or to another gas with zero or reduced pressure of the component, or by providing a getter to absorb the gaseous species. It is preferable that small changes in the concentration of the chemical component produce a significant strain increment.

Ordinarily the method of the invention operates on a workpiece constituted by a single cohesive body, which may be for example a large-scale aircraft-engine part or a thin film only several nanometers thick. However, the present invention may also be used for compacting an assembly of particles, initially comprising several distinct bodies (e.g., powder, wires, foils), to form a dense article. One embodiment applies the method of the invention to powder compaction, whereby a relatively dense macroscopic article is formed under pressure from an assembly of distinct very small particles, as is known in the art. For example, a typical assembly includes at least 10,000 particles each having diameter on the order of 1 to 500 micrometers or greater. The largest particle in an assembly characterized by an average particle diameter of 500 or 1000 micrometers may be as large as 2 millimeters, or even greater. The density of the assembly typically has a relative value of 65% compared to a density of 100% in the dense final product, corresponding to an average hydrostatic volume change of 35%, or a uniaxial strain of about $35 \div 3 \approx 12\%$. Greater or smaller volume changes, such as at least 20% are also possible. For example, cold pre-compaction of the powder assembly may render an initial relative density as high as 91%, so that the chemically induced transformation-mismatch plastic deformation of the invention changes the volume by 9%.

Using the method of the invention, it is possible to obtain the transformation-mismatch plastic effects of phase transformations previously exploited by thermal cycling—such as allotropic phase transformation between a lower-temperature phase and a higher-temperature phase—without deliberate imposition of heating or cooling operations. This approach simplifies the control equipment required to operate the treatment apparatus and decreases its energy consumption. Other benefits, related to avoiding elevated temperatures, are reduced risk of thermal fatigue of the treatment apparatus, reduced risk of undesirable grain growth in the workpiece material and reduced risk of reaction between the workpiece and apparatus.

Introduction of an alloying element that shifts the composition of the original material sufficiently so that at least some of the original material converts to a different allotropic form is one way to induce a phase transition in accordance with the invention. For example, hydrogen, vanadium and niobium are known to be beta-phase stabilizers for titanium. Adding such a stabilizer to titanium produces an alloy having a lower transus temperature between the lower-temperature alpha phase and the higher-temperature beta phase than the transus for pure titanium (about 882° C.). Consequently, adding a sufficient amount of beta stabilizer to alpha-phase titanium causes at least some of the alpha-phase material to transform to the beta phase, with an attendant change in specific volume of the transformed material and the creation of internal transformation-mismatch stresses. Removing the beta-stabilizer from the material reverses the transformation. In a preferred embodiment, transformation-mismatch plasticity is induced in a titanium-based workpiece material by changing the concentration of hydrogen therein.

The invention is not limited to transformations accessible by the thermal pathways of the prior art but also enables transformation-mismatch plastic behavior to be induced by other transformations, not accessible through temperature change alone. The method of the invention is generally applicable to materials susceptible upon change in chemical composition to a phase transformation that generates the strain increment. Some such cycles may be executable isothermally. However, the method of the invention also encompasses process pathways that include temperature change in addition to the chemical cycling, whether the temperature change occurs simultaneously with or sequentially to the chemical change. The thermal variation may be actively imposed on the workpiece or originate within the workpiece due to the imposed change in chemical concentration.

In another preferred embodiment, hydrogen concentration is changed in a metal to cause alternate precipitation and dissolution of a second, hydride phase. This technique is especially suitable for a workpiece of a titanium-based material. Titanium hydride precipitates when hydrogen is added to titanium in excess of the hydrogen solid solubility limit. The relatively high specific volume of the hydride phase translates into a molar volume mismatch on the order of 17% with respect to the original titanium. The volume mismatch generates sufficient internal stress to produce very large transformation-mismatch plastic deformation.

In one embodiment, the original workpiece material comprises a single phase. In an alternative embodiment, the workpiece material is a multiphase composite including a matrix of one or more phases and one or more additional phases. In a preferred embodiment, the change in chemical composition of the workpiece material alternately induces and reverses a phase transition in one or more transformable phases, which may be an additional phase or part of the matrix. The composite may also include one or more phases not subject to phase transformation upon the change in chemical composition. The phase distribution is selected so as to allow forward and reverse phase transformations without interfacial decohesion. Bonding between the composite's phases may contribute to the internal stress caused by the phase transition. With respect to the constituents of a composite material, the term "phase" is used herein, as it is understood by those skilled in the art, to signify a discrete, relatively homogenous part of the workpiece that is distinct from other phases in the workpiece in its physical and chemical properties.

BRIEF DESCRIPTION OF THE DRAWINGS

The foregoing discussion will be understood more readily from the following detailed description of the invention, when taken in conjunction with the accompanying drawings.

DETAILED DESCRIPTION OF A PREFERRED EMBODIMENT

Figure 1:
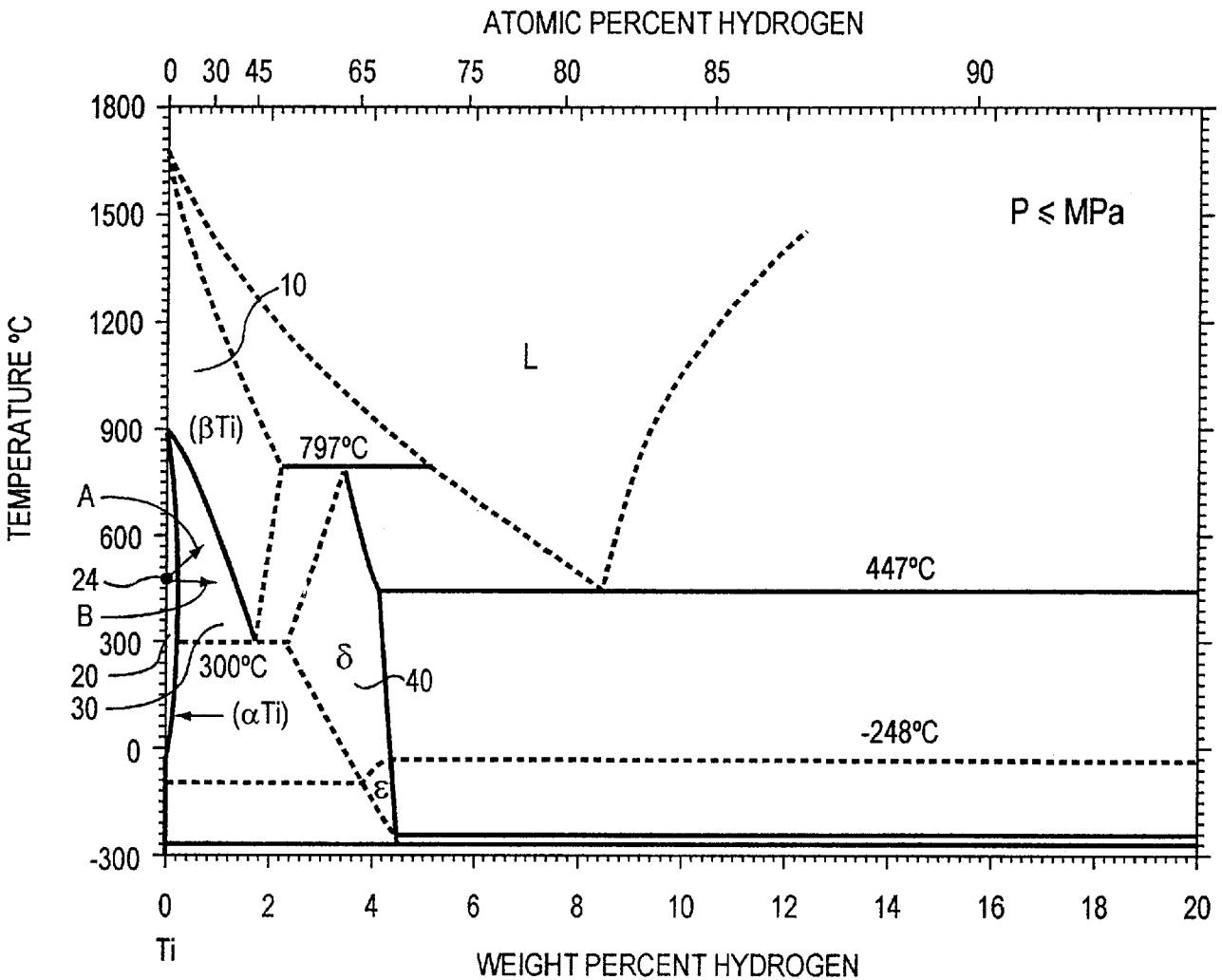
FIG. 1 is a portion of the phase diagram for the titanium-hydrogen system.

The use of hydrogen concentration cycling to induce transformation-mismatch plasticity in a titanium-based material is demonstrated with reference to FIG. 1. In pure, hydrogen-free titanium the alpha and beta phases exist over mutually distinct temperature ranges separated by the transus temperature of 882° C. At nonzero concentrations of hydrogen in titanium, the stability field 10 of the higher-temperature beta phase extends to temperatures lower than 882° C. and overlaps the temperature range of the stability field 20 of the lower-temperature alpha phase. Increasing the hydrogen concentration of a volume of alpha-phase material initially in a state 24—either along direction A or isothermally along direction B—into the two-phase field 30 causes conversion of a segment of the alpha-phase volume to the beta phase. The extent of the segment increases with the overall hydrogen content of the volume until its composition lies in the beta phase field 10.

Figure 2:
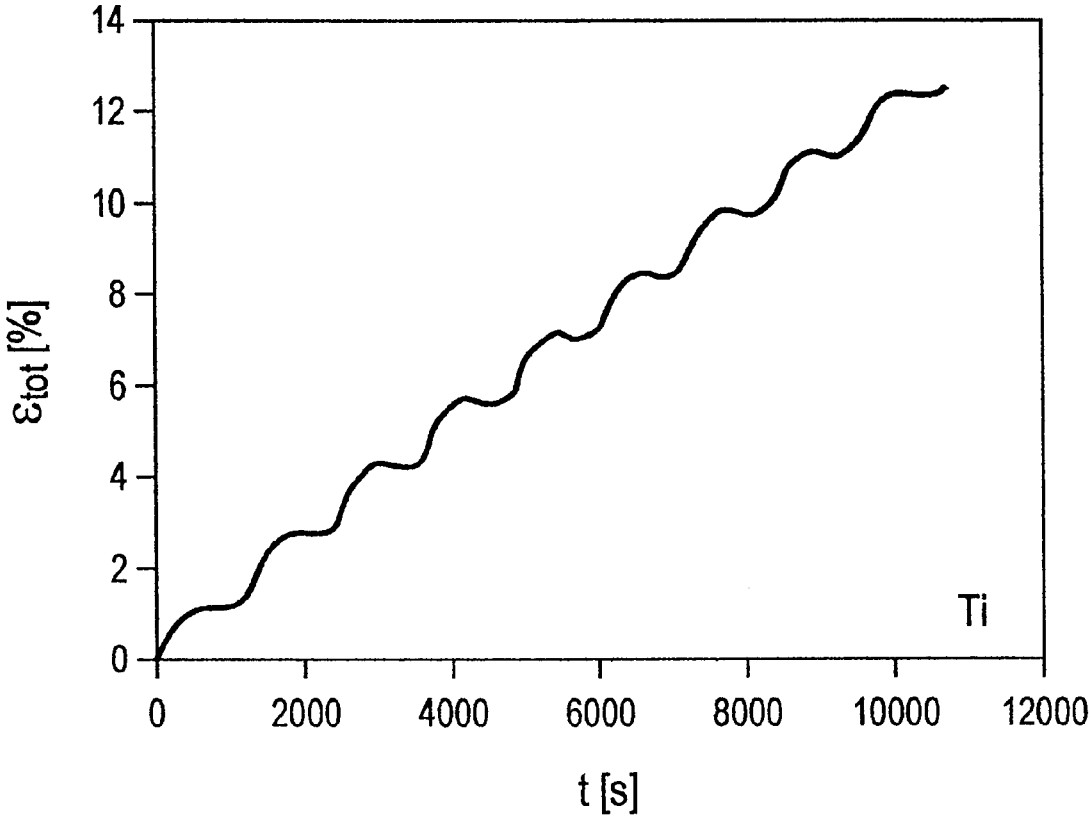
FIG. 2 graphically depicts the accumulation of transformation-mismatch plastic strain in a titanium workpiece under tensile stress during hydrogen cycling.

A nominally pure titanium sample was deformed by chemically induced alpha-beta transformation. The sample was brought to 808° C. by radiative heating. The sample was held in an argon environment and, within the alpha stability field 20 well below the transus temperature, subjected to a uniaxial tensile stress of 2.5 MPa. Hydrogen was then provided to the heated sample in tension by adding 4% hydrogen gas in the argon stream. This gas-phase hydrogen concentration was maintained for 600 seconds, after which hydrogen was withdrawn from the sample by restoring the pure argon stream for 600 seconds. FIG. 2 shows the strain increment present after this 1200-second cycle due to the difference in specific volume between the alpha and beta phases. A total of nine hydrogen concentration cycles were applied to the sample in tension which was maintained at a constant temperature throughout the cycling. As illustrated in FIG. 2, additional strain accumulates with each cycle. The total strain was over 12%, corresponding to about 1.4% per cycle, which is much greater than deformations seen in identical samples maintained under the same conditions in an argon or argon-hydrogen atmosphere without chemical cycling.

Many variations of this process are within the scope of the invention. For titanium, tensile stresses up to about 10 MPa or even higher may be used, the strain introduced per cycle increasing with applied stress. Additional steps may be included. For example, when the desired deformation has been achieved, residual hydrogen may be removed by vacuum annealing if desired.

Chemically induced transformation-mismatch plasticity using hydrogen is also appropriate for workpiece materials other than pure titanium. For example, hydrogen similarly affects phase relationships in titanium-based materials, for example titanium alloys such as Ti6Al4V. Other allotropic metals such as zirconium, neodymium, lanthanum, strontium, and uranium and their alloys also show phase relationships that allow chemical induction of transformation-mismatch plasticity by cycling hydrogen concentration. Allotropic and nonallotropic metals that form hydrides with mismatch with respect to the host metal matrix—such as titanium, zirconium, niobium, tantalum and vanadium—are deformable through chemically induced transformation plasticity by addition of hydrogen under hydride-forming conditions. In the case of titanium, such a process converts a segment of the workpiece to the delta phase, which, with reference again to FIG. 1, has single-phase stability field 40. (This approach is easily combined with microstructure refinement of titanium, by cyclic hydriding and dehydriding, for improving its room-temperature properties.)

Chemical composition may also be changed reversibly using nitrogen or oxygen in materials based on, respectively, nitride or oxide ceramics, or based on allotropic metals such as iron, titanium, zirconium, and yttrium. Carbon may be delivered to an iron-based workpiece material by a gas such as methane and then removed by reaction with a gas such as hydrogen or oxygen.

It will therefore be seen that the foregoing represents a highly advantageous approach to inducing plastic and superplastic deformation. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of inducing transformation-mismatch plasticity in a workpiece having a mass, the mass having an initial value, the workpiece being of a material susceptible to a phase transition upon changing concentration therein of a chemical component, the method comprising the steps of:

a. changing in a first direction the concentration of the chemical component in the workpiece while the workpiece is subject to a biasing stress, thereby inducing the phase transition; and b. changing in a second direction, opposite to the first direction, the concentration of the chemical component in the workpiece while the workpiece is subject to the biasing stress, thereby reversing the phase transition, the alternate inducing and reversing introducing a strain increment generating a change of about 0.5% in effective von Mises strain at a location in the workpiece, without increasing the mass of the workpiece except optionally due to incorporation of the chemical component therein.

2. The method of claim 1 wherein at least one of the changing in a first direction and the changing in a second direction occurs at constant temperature.

3. The method of claim 1 wherein at least one of the changing in a first direction and the changing in a second direction.

4. The method of claim 1 further comprising alternately repeating steps a and b at least once, each repetition introducing a strain increment, the change in effective von Mises strain being due to accumulation of strain increments.

5. The method of claim 4 wherein the change in effective von Mises strain corresponds to an average change of at least about 0.5% per repetition.

6. The method of claim 1 wherein the biasing stress is noncompressive.

7. The method of claim 1 wherein the biasing stress comprises an internal stress.

8. The method of claim 7 wherein the workpiece has internal cavities and the alternative inducing and reversing causing the internal cavities in the workpiece to be expanded, thereby foaming the material.

9. The method of claim 1 wherein the changing in a first direction comprises is increasing the concentration.

10. The method of claim 9 wherein the transition comprises precipitation of at least one second phase in the workpiece material, the second phase alternately precipitating and dissolving during steps a and b.

11. The method of claim 9 wherein the phase transition comprises formation of a compound containing an element of the chemical component and an element of the material.

12. The method of claim 9 wherein the changing in a first direction causes the concentration of the component in the material to exceed its solubility limit.

13. The method of claim 11 wherein the compound is a hydride.

14. The method of claim 13 wherein the compound is a titanium hydride.

15. The method of claim 13 wherein the material includes a phase of zirconium, niobium, tantalum or vanadium or of an alloy based thereon.

16. The method of claim 1 wherein the phase transition introduces a change in specific volume in a transformed segment of the material.

17. The method of claim 1 wherein the transition is allotropic.

18. The method of claim 17 wherein the material includes a phase of zirconium, neodymium, lanthanum, strontium, or uranium or of an alloy based thereon.

19. The method of claim 17 wherein the material includes a phase of iron, zirconium, or yttrium or of an alloy based thereon.

20. The method of claim 17 wherein the material includes a phase of titanium or of a titanium-based alloy.

21. The method of claim 20 wherein the phase transition converts a titanium-based alpha phase to a titanium-based beta phase.

22. The method of claim 1 wherein the component is hydrogen.

23. The method of claim 22 wherein the material includes a phase of zirconium, neodymium, lanthanum, strontium, or uranium or of an alloy based thereon.

24. The method of claim 22 wherein the material includes a phase of titanium or of an alloy based thereon.

25. The method of claim 1 wherein the component is carbon.

26. The method of claim 25 wherein the material includes a phase of iron or of an alloy based thereon.

27. The method of claim 1 wherein the component is oxygen or nitrogen.

28. The method of claim 27 wherein the material includes a phase of iron, zirconium, titanium, or yttrium or of an alloy based thereon.

29. The method of claim 27 wherein the material includes a phase of an oxide ceramic or a nitride ceramic.

30. The method of claim 1 wherein the material contains titanium.

31. The method of claim 30 wherein the material includes a phase of titanium metal or of an alloy based thereon.

32. The method of claim 30 wherein the material is a composite material comprising a matrix and one or more additional phases.

33. The method of claim 1 wherein the phase transition creates a front between an original phase and a new phase, the front originating at a region where the concentration change is introduced into the workpiece and moving therefrom into the workpiece.

34. The method of claim 1 wherein one of changing in the first and second directions comprises conveying a gas to the workpiece.

35. The method of claim 34 wherein the gas contains a species that reacts to form the chemical component at the workpiece.

36. The method of claim 34 wherein the gas contains the chemical component.

37. The method of claim 1 wherein one of changing in the first and second directions comprises providing a getter to absorb a gaseous species.

38. The method of claim 1 wherein one of changing in the first and second directions comprises exposing the workpiece to vacuum.

39. The method of claim 1 wherein one of changing in the first and second directions comprises providing a reactant to a surface of the workpiece, the reactant reacting with the chemical component to produce a gaseous species.

40. The method of claim 1 wherein the biasing stress has a tensile component.

41. The method of claim 1 wherein the biasing stress is nonhydrostatic.

42. The method of claim 1 wherein the workpiece is of a composite material comprising a matrix and one or more additional phases and having a transformable phase susceptible to a phase transition upon change in concentration therein of the chemical component, the changing in the first and second directions alternately inducing and reversing the phase transition in the transformable phase.

43. The method of claim 42 wherein the composite material includes a nontransformable phase not susceptible to a phase transition upon change in concentration in the workpiece of the chemical component at the temperature.

44. The method of claim 42 wherein the matrix comprises the transformable phase.

45. The method of claim 42 wherein the one or more additional phases comprise the transformable phase.

46. The method of claim 42 wherein the biasing stress comprises an internal stress.

47. The method of claim 42 further comprising the step of applying an external stress to the workpiece during the transition to subject the workpiece to the biasing stress.

48. The method of claim 1 wherein the change in effective von Mises strain is at least about 1.0%.

49. The method of claim 1 wherein the change in effective von Mises strain is at least about 1.5%.

50. The method of claim 1 further comprising the step of applying an external stress to the workpiece to subject the workpiece to the biasing stress during the phase transition.

51. The method of claim 1 wherein changing the concentration in the first and second directions causes a net increase in the mass of the workpiece due to incorporation of the chemical component therein.

52. The method of claim 1 wherein changing the concentration in the first and second directions causes no net increase in the mass of the workpiece.

53. The method of claim 1 wherein changing the concentration in the first and second directions restores the mass of the workpiece to a final value within 0.01% of the initial value.

54. A method of inducing transformation-mismatch plasticity in a workpiece, the workpiece having a mass and being of a composite material comprising a matrix and one or more additional phases, the composite material having a transformable phase susceptible to a phase transition upon change in concentration therein of a chemical component, the method comprising the steps of:

a. providing the chemical component to the workpiece while the workpiece is subject to a biasing stress, thereby inducing the phase transition in the transformable phase; and b. removing the chemical component from the workpiece while the workpiece is subject to a biasing stress, thereby reversing the phase transition in the transformable phase, the alternate inducing and reversing introducing a strain increment generating a change of about 0.5% von Mises strain at a location in the workpiece so as to generate a change in an overall dimension of the workpiece without increasing the mass of the workpiece except optionally due to incorporation of the chemical component therein.

55. The method of claim 54 wherein the composite material includes a nontransformable phase not susceptible to a phase transition upon change in concentration in the workpiece of the chemical component at the temperature.

56. The method of claim 54 wherein the matrix comprises the transformable phase.

57. The method of claim 54 wherein the one or more additional phases comprise the transformable phase.

58. The method of claim 54 wherein the biasing stress comprises an internal stress.

59. The method of claim 54 further comprising the step of applying an external stress to the workpiece during the transition to subject the workpiece to the biasing stress.

60. The method of claim 54 wherein the biasing stress has a tensile component.

61. A method of inducing transformation-mismatch plasticity in a workpiece having a mass, the workpiece being of a titanium-based material susceptible to a phase transition, upon change in concentration therein of hydrogen, the method comprising the steps of:

a. providing hydrogen to the workpiece while the workpiece is subject to a biasing stress;

b. removing hydrogen from the workpiece while the workpiece is subject to the biasing stress; and c. alternately repeating steps a and b, thereby alternately inducing and reversing the phase transition, each repetition introducing a strain increment generating a change of about at least 0.5% in effective von Mises strain at a location in the workpiece, without increasing the mass of the workpiece except optionally due to incorporation of hydrogen therein.

62. The method of claim 61 wherein the phase transition introduces a change in specific volume in a transformed segment of the material.

63. The method of claim 61 further comprising the step of applying an external stress during the transition to the workpiece to subject the workpiece to the biasing stress.

64. The method of claim 61 wherein the transition is allotropic.

65. The method of claim 64 wherein the phase transition isothermally converts an alpha phase to a beta phase.

66. The method of claim 61 wherein the transition comprises precipitation of a precipitate compound containing titanium and hydrogen, the precipitate compound alternately precipitating and dissolving.

67. A method of inducing mismatch plasticity in a workpiece comprising a material and having a mass, the method comprising altering the concentration in the workpiece of a chemical component while the workpiece is subject to a biasing stress, thereby introducing a strain increment generating a change of at about least 0.5% in effective von Mises strain at a location in the workpiece, without increasing the mass of the workpiece except optionally due to incorporation of the chemical component therein.

68. The method of claim 67 wherein altering the concentration of the workpiece comprises changing alternately in a first direction and in a second, opposite direction the concentration of the chemical component in the workpiece.

69. The method of claim 68 further comprising repeating at least once the alternate changing in first and second directions of the concentration of the chemical component, each repetition introducing a strain increment, the change in effective von Mises strain being due to accumulation of strain increments.

70. The method of claim 69 wherein the change in effective von Mises strain corresponds to an average change of at least about 0.5% per repetition.

71. The method of claim 67 wherein altering the concentration permanently changes a total amount of the chemical component in the workpiece.

72. The method of claim 67 wherein altering the concentration induces a phase transition in the workpiece.

73. The method of claim 72 wherein the phase transition introduces a change in specific volume in a transformed segment of the material.

74. The method of claim 67 wherein the biasing stress is nonhydrostatic.

75. The method of claim 67 wherein internal cavities in the workpiece are expanded, thereby foaming the material.

76. The method of claim 67 wherein the biasing stress has a tensile component.

77. The method of claim 67 wherein the biasing stress comprises an internal stress.

78. The method of claim 67 further comprising the step of applying an external stress to the workpiece in order to subject the workpiece to the biasing stress during the transition.

79. The method of claim 67 wherein the component is hydrogen.

80. The method of claim 67 wherein the component is aluminum.

81. The method of claim 80 wherein the material includes a phase of titanium or of a titanium-based alloy.

82. The method of claim 67 wherein altering the concentration comprises conveying a gas to or from the workpiece.

83. The method of claim 67 wherein the material is a composite material comprising a matrix and one or more additional phases.

84. A method of inducing mismatch-transformation plasticity in a workpiece having a mass, the workpiece being of a material susceptible to a phase transformation, upon change in concentration therein of a chemical component, the phase transformation comprising formation of a compound containing an element of the chemical component and an element of the material, the method comprising the steps of:

a. providing the chemical component to the workpiece while the workpiece is subject to a biasing stress, thereby forming of the compound; and b. removing the chemical component from the workpiece while the workpiece is subject to the biasing stress, thereby dissolving the compound, the alternate forming and dissolving the compound introducing a strain increment in the workpiece, a change of at least about 0.5% in effective von Mises strain at a location in the workpiece without increasing the mass of the workpiece except optionally due to incorporation of at least one element of the chemical component therein.

85. The method of claim 84 wherein the compound is a hydride.

86. The method of claim 85 wherein the material includes a phase of niobium, tantalum or vanadium or of an alloy based thereon.

87. The method of claim 85 wherein the material includes a phase of zirconium or of an alloy based thereon.

88. The method of claim 84 wherein the compound is a titanium hydride.

89. The method of claim 84 wherein the biasing stress is nonhydrostatic.

90. The method of claim 84 wherein the biasing stress has a tensile component.

91. A method of inducing mismatch-transformation plasticity in a workpiece having a mass, the workpiece being of a material susceptible to a phase transformation, upon change in concentration therein of a chemical component, the phase transformation comprising formation of a compound containing an element of the chemical component and an element of the material, the method comprising the steps of:

a. providing the chemical component to the workpiece while the workpiece is subject to a biasing stress, thereby forming of the compound; and b. removing the chemical component from the workpiece while the workpiece is subject to the biasing stress, thereby dissolving the compound, the alternate forming and dissolving the compound introducing a strain increment in the workpiece, without increasing the mass of the workpiece except optionally due to incorporation of at least one element of the chemical component therein, c. alternatively repeating steps a and b at least once, each repetition introducing a strain increment, wherein accumulation of strain increments generates a change in effective von Mises strain corresponding to at least about 0.5% per repetition at a location in the workpiece.

92. A method of compacting a plurality of powder particles into a dense body by mismatch plasticity, the method comprising the steps of:

a. forming an unbonded assembly from the plurality of particles, the assembly having a volume and a mass;

b. altering the concentration of a chemical component in at least some of the partides in the assembly while the assembly is subject to a biasing stress, thereby introducing a strain increment such that the volume of the assembly is reduced, without increasing the mass of the assembly except optionally due to incorporation of the chemical component therein.

93. The method of claim 92 wherein an average size characterizes the particles in the assembly, the average size being less than about 1 millimeter.

94. The method of claim 93 wherein a largest particle in the assembly has a diameter of at least about 2 millimeters.

95. The method of claim 92 wherein an average size characterizes the particles in the assembly, the average size being less than about 0.5 millimeter.

96. The method of claim 95 wherein the assembly contains a largest particle, the largest particle having a diameter of at least about 2 millimeters.

97. The method of claim 92 wherein the volume is reduced by at least 35%.

98. The method of claim 92 wherein the volume is reduced by at least 20%.

99. The method of claim 92 wherein the volume is reduced by at least 5%.

100. The method of claim 92 wherein at least some of the plurality of particles are of a material susceptible to a phase transition, upon changing concentration therein of the chemical component, the step of altering the concentration of the chemical component in at least some of the particles inducing the phase transition.

101. The method of claim 100 wherein the step of altering the concentration of the chemical component in the assembly includes alternately providing and removing chemical component to the assembly while the assembly is subject to the biasing stress, the alternate providing and removing alternately inducing and reversing the phase transition.

102. The method of claim 92, wherein the altering the concentration is performed at a temperature above ambient.

* * * * *